United States Patent [19]

Stahl et al.

[11] 4,437,212

[45] Mar. 20, 1984

[54] CLASP FOR GARMENTS, IN PARTICULAR FURS

[75] Inventors: Juergen Stahl; Wilhelm Schuster; Wilhelm Wegner, all of Frankfurt am Main, Fed. Rep. of Germany

[73] Assignee: Gold- Und Silber-Scheideanstalt Oberstein Franz Reischauer, Idar-Oberstein, Fed. Rep. of Germany

[21] Appl. No.: 322,163

[22] Filed: Nov. 17, 1981

[30] Foreign Application Priority Data

Dec. 1, 1980 [DE] Fed. Rep. of Germany ..... 3045169

[51] Int. Cl.[3] ..... A44B 13/00; A44B 1/18

[52] U.S. Cl. ..... 24/698; 24/695

[58] Field of Search ..... 24/225, 226, 227, 228, 24/237, 201 HE, 230.5 TP, 343, 369, 230.5 R, 363; 54/55, 61

[56] References Cited

U.S. PATENT DOCUMENTS

| | | | |
|---|---|---|---|
| 404,643 | 6/1889 | Moliere | 54/61 |
| 513,780 | 1/1894 | Harris | 54/55 |
| 531,442 | 12/1894 | Mason et al. | 24/226 |
| 696,970 | 4/1902 | Hodges | 24/230.5 R |
| 741,619 | 10/1903 | Bowles | 54/61 |
| 798,271 | 8/1905 | Donalds | 24/225 |
| 891,202 | 6/1908 | Borhek | 24/228 |
| 944,788 | 12/1909 | Katzenmeyer | 24/226 |
| 1,176,110 | 3/1916 | Uhlig | 24/230.5 R |
| 1,339,986 | 5/1920 | Schmidt | 24/230.5 R |
| 3,095,626 | 7/1963 | Gubbels | 24/225 |
| 3,665,562 | 5/1972 | Gower | 24/230.5 R |

FOREIGN PATENT DOCUMENTS

| | | | |
|---|---|---|---|
| 1118714 | 12/1961 | Fed. Rep. of Germany | 24/225 |
| 5780 | of 1887 | United Kingdom | 24/363 |

*Primary Examiner*—John J. Wilson

*Attorney, Agent, or Firm*—Fisher, Cristen & Sabol

[57] ABSTRACT

Clasp for garments, in particular furs, which includes an eye element and a hook element having a base plate to be fixed to the garment, a positioning web and a locking web. The hook element is made in a single piece. Also the hook element is provided with a hold-down arm which holds the hooked-in eye down against the positioning web or the locking web (depending on the load applied or the direction of force) and which is elastically movable in a direction normal to the base plate for hooking the eye in or out.

14 Claims, 2 Drawing Figures

CLASP FOR GARMENTS, IN PARTICULAR FURS

BACKGROUND OF THIS INVENTION

1. Field Of This Invention

This invention relates to a clasp suited for garments, in particular for furs.

2. Prior Art

The clasp involved in the prior art consists of an eye element and a hook element which is provided with a base plate to be fixed to the garment, a positioning web and a locking web. To close the two matching parts of the garment, the eye is hooked or engaged in the hook element.

In their simplest form the known hook-eye clasps consist of open U-shaped hooks into which the respective eye is inserted. Such open hooks are, however, not secured against unintentional opening.

Besides, hooks with elastic legs are known whose open U-ends are closed by an elastic or rigid bar, so that the eyes have to be engaged against the resistance of the elastic part of the hook.

The clasps most commonly used today are hook-eye clasps provided with a tilting bow. This tilting bow is guided in a pin support and kept in open or closed position by means of incorporated spring elements; it thus has two stable positions.

Finally, a clasp is known whose hook element consists of a rigid L-shaped bow fixed on a base plate and a rigid locking bar arranged on the push-in side of the eye and which has in the leg of the L-shaped hook parallel to the base plate a spring partly recessed in the leg. The spring closes the push-in slit between this leg and the locking bar and can be pushed back for hooking the eye in (German Patent Specification No. 11 18 714). The main purpose of avoiding a tilting bow in this type of clasp is to achieve gentle handling of the fur.

The hook elements of all known hook-eye clasps—except the primitive hook which does not provide any safety against unintentional opening—consist of several elements, which makes their production cost rather high. In addition, these clasps are awkward to use and require too much time for opening and closing. Besides, tilting bows damage the valuable fur around the clasps, because in each closing process hairs are caught between the eye and the engaging tilting bow.

BROAD DESCRIPTION OF THIS INVENTION

The main object of this invention therefore is to create a clasp that is easy and inexpensive to produce as well as easy and convenient to handle while at the same time provides a high degree of safety against unintentional opening. Other objects and advantages of this invention are set out herein or are obvious herefrom to one ordinarily skilled in the art.

The objects and advantages of this invention are achieved by the clasp according to this invention in a surprising simple way.

This invention involves a clasp for garments, in particular furs. The clasp consists of an eye element and a hook element having a base plate to be fixed to the garment, a positioning web and a locking web. The hook element is made in a single piece and is provided with a hold-down arm or segment which holds the hooked-in eye down against the positioning web or the locking web, depending on the load applied or the direction of force, and which is elastically movable in a direction normal to the base plate for hooking the eye in or out.

The following is a description of advantageous embodiments of this invention preferably the clasp has an entrance slit located between the hold-down arm and the locking web and such slit has a width corresponding to approximately 0.3 to 0.5 times the thickness of the eye ring of the matching eye element. Preferably the clasp has an inclined slide face or slide edge facing toward the entrance slit on the outward facing side of the hook element both at the locking web and the hold-down. Also preferably the positioning web of the clasp is provided with a recess immediately at the hold-down—such recess serves as the eye bearing and its size roughly corresponding to the thickness of the eye ring. Preferably all of the parts of the hook element, which engage the eye lement, are connected to the base plate by means of an elongated narrow ridge.

DETAILED DESCRIPTION OF THIS INVENTION

Figure 1:
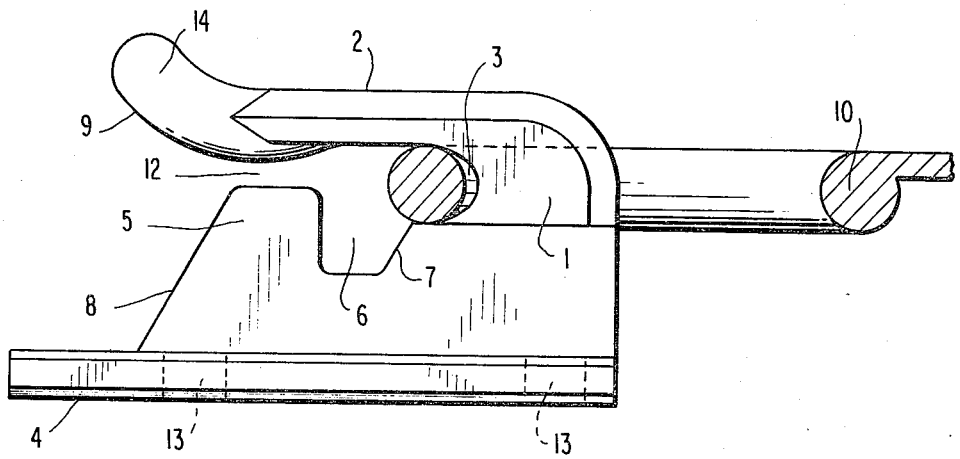

Further structural features, advantages and potential applications of this invention result from the following description of a specific embodiment of this invention and from the attached drawings.

Figure 2:
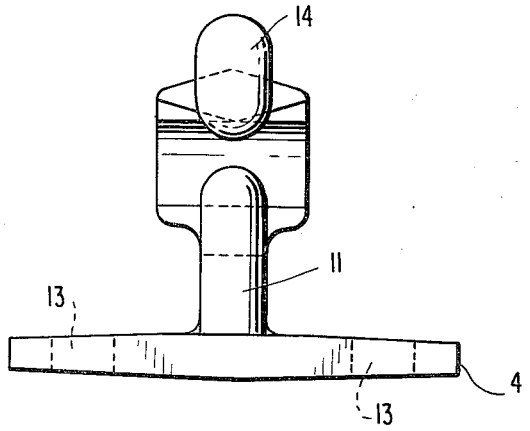

In the drawings:

FIG. 1 shows the side view of the hook element of a clasp according to this invention with the matching engaged eye element depicted only in part; and FIG. 2 shows the front view of the hook element according to FIG. 1.

As can be seen from FIG. 1 and by comparison with FIG. 2, the hook element of the clasp according to this invention consists essentially of base plate 4, positioning web 1, locking web 5 and hold-down arm 2. Base plate 4 has at least three holes 13 for fastening, i.e., for sewing the hook element on to the garment. The matching eye element, of which FIG. 1 shows only ring-shaped eye 10 (this ring being shown in sectional view), is sewn on to the matching second part of the garment.

Hold-down arm 2 can be elastically bent. For closing, i.e., for hooking the eye into the hook element, eye 10 can therefore be engaged by pushing it through slit 12 between hold-down 2 and locking web 5. In this embodiment of this invention the width of entrance slit 12 corresponds to about ⅓ of the ring diameter of eye 10. The tensile force to be applied for engaging eye 10 in the hook element is determined by the distance between hold-down 2 and locking web 5 as well as by the elasticity of hold-down 2. Insertion of eye 10 into the hook element is facilitated by two slide faces 8 and 9 provided at locking web 5 and hold-down arm 2, respectively, which together form a beak-shaped inlet for eye 10.

The base plate 4 has narrow integral ridge 11 in vertical axial direction (see FIG. 2) which carries the remaining parts of the hook element. When the garment is being worn, i.e., when the clasp is hooked in and is subject to continuous tensile load, eye 10 normally is in notch 3, which serves as the bearing for this eye and can absorb even relatively high tensile loads. When the load on eye 10 is reduced while the garment is being worn or if eye 10 is moved toward entrance slit 12 against the normal direction of load application, hold-down 2 causes the motion of eye 10 to be stopped at the face of locking web 5, this face being vertical in this embodiment. Hold-down arm 2 is not bent in this process. The two clasp elements remain hooked. Therefore, there is no danger that the clasp will be opened accidentally.

Inclined slide face 7 extends from the lowest point of recess 6 between positioning web 1 and locking web 5; when the clasp is loaded in the direction of pull, slide face 7 guides eye 10 into notch 3 which serves as an eye bearing. In this embodiment of this invention the ring even engages in notch 3.

Head 14 at hold-down arm 2, which is provided with slide face 9, is easy to identify by touch so that eye 10 can be "blindly", i.e., without looking, inserted and engaged in the hook element.

Opening a garment equipped with the clasp according to this invention is very easy. It is sufficient to slip the hand between the two overlapping part of the garment, whereby eye 10 is removed from its bearing 3 and exerts a tensile force on hold-down arm 2 in a direction normal to the base plate, thus causing hold-down arm 2 to be elastically moved to such an extent that eye 10 can slide out of the hook element along the lower face of hold-down arm 2.

Both the hook element and the eye element of the clasp according to this invention can be produced easiest by injection molding from an elastic plastic material. As the elements are made in integral pieces, no subsequent treatment or assembly is necessary. By using injection molding compounds in different colors, it is possible to match the clasp of this invention according to the appearance and color of the garment, the fur or the lining; when the garment is worn open, the clasp elements are thus hardly visible or at least inconspicuous. It is also possible, however, to make the clasps of a metal; in such case their production in two integral parts is also economical.

As the base plate of the hook element can be sewn on the reverse side of the garment between the fabric or fur and the lining, only the elevated webs and the hold-down arm remain visible. In the embodiment of this invention described here, the visible parts of the hook element are no larger than about 0.5 $cm^2$.

What is claimed is:

1. Hook element of a clasp for garments, in particular furs, which is used in conjunction with an eye element having an eye ring, the hook element consisting of:

(a) a base plate having holes therein for fastening to a garment;

(b) a narrow integral ridge extending in the vertical axial direction and mounted on base plate (a), base plate (a) and narrow integral ridge (b) having a fixed positional relationship;

(c) a hold-down arm, which is elastically movable in a direction normal to base plate (a), connected on one end to elongated narrow integral ridge (b) so as to form a passageway between narrow integral ridge (b) and hold-down arm (c);

(d) a first recess and a second recess provided in narrow integral ridge (b), the first and second recesses facing onto the passageway between narrow integral ridge (b) and hold-down arm (c), a locking web being formed by the portion of narrow integral ridge (b) between the end thereof and the first recess, the second recess being positioned further in the passageway than the first recess and being located in the region of narrow integral ridge (b) at the connection between hold-down arm (c) and narrow integral ridge (b), a positioning web being formed by the portion of narrow integral ridge (b) where the second recess is located; and (e) an entrance slit provided in the passageway between hold-down arm (c) and the locking web, the hook element, when engaged in the passageway, can slide between the first and second recesses and its motion is stopped by the locking web or the positioning web depending upon its direction of movement.

2. Hook element as claimed in claim 1 wherein the slit has a width which corresponds to approximately 0.3 to 0.5 times the thickness of the eye ring of the matching eye element.

3. Hook element as claimed in claim 1 or 2 wherein an inclined slide face or slide edge facing toward the entrance slit is provided on the outward facing side of both the locking web and hold-down arm (c).

4. Hook element as claimed in claim 3 wherein the second recess serves as an eye bearing for the eye ring of the eye element, with the size of the second recess approximately corresponding to the thickness of the eye ring.

5. Hook element as claimed in claim 3 wherein all of the parts of the hook element, which engage the eye element, are connected to base plate (a) by means of elongated narrow ridge (c).

6. Hook element as claimed in claim 1 wherein the second recess serves as an eye bearing for the eye ring of the eye element, with the size of the second recess approximately corresponding to the thickness of the eye ring.

7. Hook element as claimed in claim 1 wherein all of the parts of the hook element, which engage the eye element, are connected to the base plate (a) by means of elongated narrow ridge (c).

8. A clasp for garments, in particular furs, having a body entrance passageway or the like comprising the combination of an eye element having an eye ring and a hook element, the eye ring being engagable and disengagable with the hook element, the eye element being mounted on or near one edge of the body entrance passageway of the garment and the hook element being mounted on or near the other edge of the body entrance passageway in engagable relationship with the eye element, the hook element consisting of:

(a) a base plate having holes therein for fastening to a garment;

(b) a narrow integral ridge extending in the vertical axial direction and mounted on base plate (a), base plate (a) and narrow integral ridge (b) having a fixed positional relationship;

(c) a hold-down arm, which is elastically movable in a direction normal to base plate (a), connected on one end to elongated narrow integral ridge (b) so as to form a passageway between narrow integral ridge (b) and hold-down arm (c);

(d) a first recess and a second recess provided in narrow integral ridge (b), the first and second recesses facing onto the passageway between narrow integral ridge (b) and hold-down arm (c), a locking web being formed by the portion of narrow integral ridge (b) between the end thereof and the first recess, the second recess being positioned further in the passageway than the first recess and being located in the region of narrow integral ridge (b) at the connection between hold-down arm (c) and narrow integral ridge (b), a positioning web being formed by the portion of narrow integral ridge (b) where the second recess is located; and (e) an entrance slit provided in the passageway between hold-down arm (c) and the locking web, the hook element, when engaged in the passageway, can slide between the first and second recesses and its motion is stopped by the locking web or the positioning web depending upon its direction of movement.

9. Clasp as claimed in claim 8 wherein an entrance slit is provided in the passageway between hold-down arm (c) and the locking web, and the slit has a width which corresponds to approximately 0.3 to 0.5 times the thickness of the eye ring of the matching eye element.

10. Clasp as claimed in claim 9 wherein an inclined slide face or slide edge facing toward the entrance slit is provided on the outward facing side of both the locking web and hold-down arm (c).

11. Clasp as claimed in claim 10 wherein the second recess serves as an eye bearing for the eye ring of the eye element, with the size of the second recess approximately corresponding to the thickness of the eye ring.

12. Clasp as claimed in claim 10 wherein all of the parts of the hook element, which engage the eye element, are connected to base plate (a) by means of elongated narrow ridge (c).

13. Clasp as claimed in claim 8 wherein the second recess serves as an eye bearing for the eye ring of the eye element, with the size of the second recess approximately corresponding to the thickness of the eye ring.

14. Clasp as claimed in claim 8 wherein all of the parts of the hook element, which engage the eye element, are connected to base plate (a) by means of elongated narrow ridge (c).

* * * * *